United States Patent [19]

Moog

[11] 4,213,367

[45] Jul. 22, 1980

[54] MONOPHONIC TOUCH SENSITIVE KEYBOARD

[75] Inventor: Robert A. Moog, Williamsville, N.Y.

[73] Assignee: Norlin Music, Inc., Lincolnwood, Ill.

[21] Appl. No.: 882,262

[22] Filed: Feb. 28, 1978

Related U.S. Application Data

[63] Continuation of Ser. No. 591,853, Jun. 30, 1975, abandoned.

[51] Int. Cl.[2] ..... G10H 1/02; G10H 5/00

[52] U.S. Cl. ..... 84/1.22; 84/1.1; 84/1.24; 84/1.27; 84/DIG. 7

[58] Field of Search ..... 84/1.01, 1.1, 1.22, 84/1.24, 1.27, DIG. 7

[56] References Cited

U.S. PATENT DOCUMENTS

| | | | |
|---|---|---|---|
| Re. 21,554 | 9/1940 | Curtis | 84/1.22 |
| 2,308,051 | 1/1943 | Cahill | 84/1.27 X |
| 2,314,496 | 3/1943 | Hammond | 84/1.27 X |
| 2,931,877 | 4/1960 | Henley | 84/1.27 X |
| 3,328,507 | 6/1967 | Peterson | 84/1.1 X |
| 3,708,605 | 1/1973 | Ohno | 84/1.1 |
| 3,943,812 | 3/1976 | Nagai et al. | 84/1.1 |
| 3,960,044 | 6/1976 | Nagai et al. | 84/1.01 |
| 3,965,789 | 6/1976 | Pearlman | 84/1.24 |
| 3,968,717 | 7/1976 | Clark, Jr. et al. | 84/1.24 X |
| 4,027,569 | 6/1977 | Luce et al. | 84/1.1 |

FOREIGN PATENT DOCUMENTS

| | | | |
|---|---|---|---|
| 580779 | 8/1959 | Canada | 84/1.27 |

*Primary Examiner*—S. J. Witkowski

*Attorney, Agent, or Firm*—Hill, Van Santen, Steadman, Chiara & Simpson

[57] ABSTRACT

A keyboard for a monophonic musical instrument has a plurality of touch sensitive keys which function as variable capacitors, the capacitance depending on the force applied to the keys. The variable capacitance is detected and used to produce a variable control voltage which is used to execute one or several of various control functions, such as controlling the volume of the sound produced by The instrument, controlling the cutoff frequency of a low pass filter in the output system of the instrument, controlling the amount of vibrato or other periodic modulation introduced into the sounds produced by the instrument, controlling the frequency of the vibrato or other periodic modulation, or controlling the amount of "bend" in the pitch of a sound produced by the instrument, i.e. shifting the pitch slightly from its nominal value. The variable capacitors employ a conductive elastomer which is deformed in response to the force applied to the keys. The changes in the capacitance are converted to a DC voltage which is used to control the amplitude of an output signal.

13 Claims, 14 Drawing Figures

+V
25
CURRENT GENERATOR
89
70
HIGH GAIN AMPLIFIER
72
LEVEL SET
VARIABLE FREQUENCY OSCILLATOR
54
58
52
PEAK DETECTOR
ADDER
D.C. AMPLIFIER
60
55
57
56
59
16

73
74
75
76
83
84
85a
85
+V
60
57
54
77
79c
80
59
16
74
79a
79b
78
79
+V
56
81
58
+V
90
+V
70
72
+V
89
91
25
93
94
88

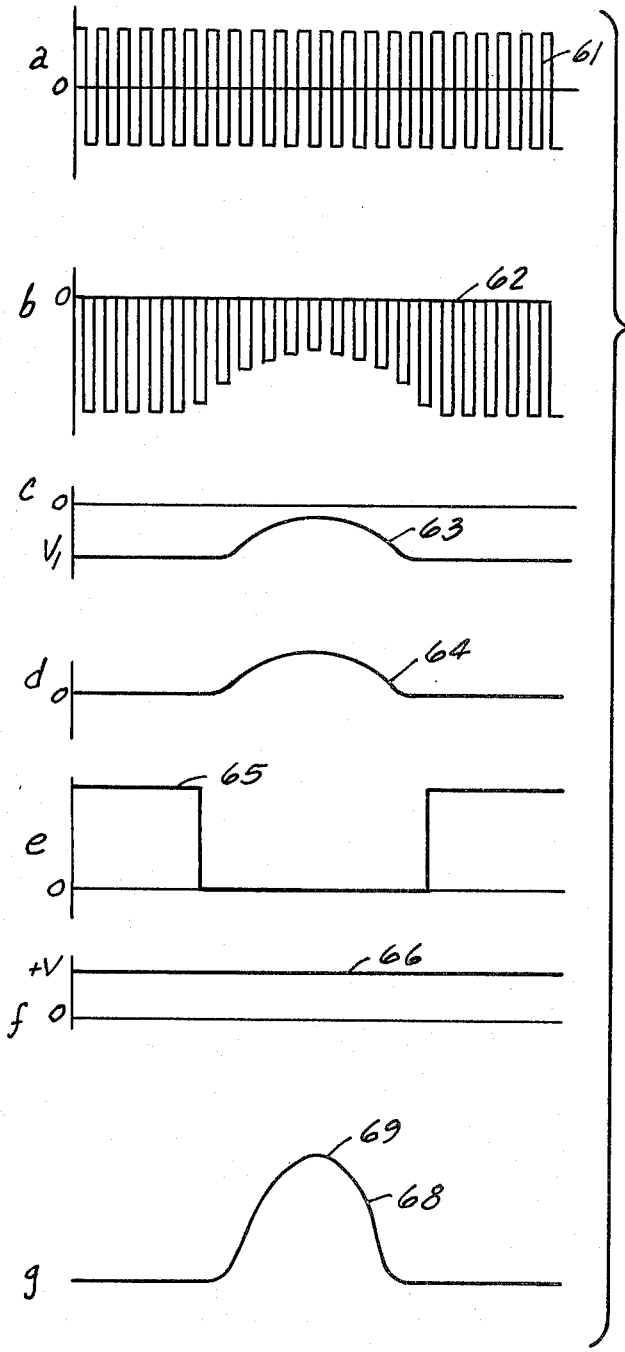
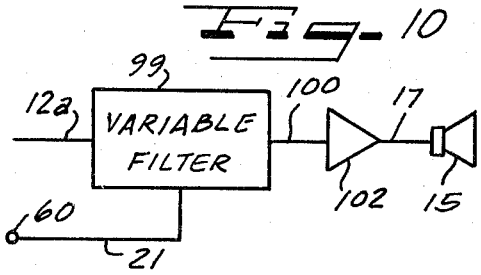
FIG. 10
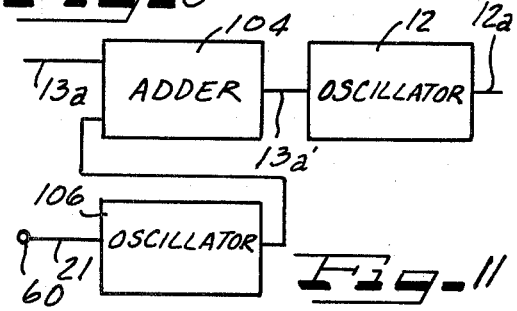
FIG. 8
FIG. 11
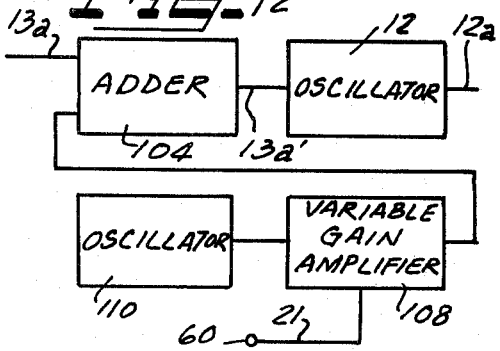
FIG. 12
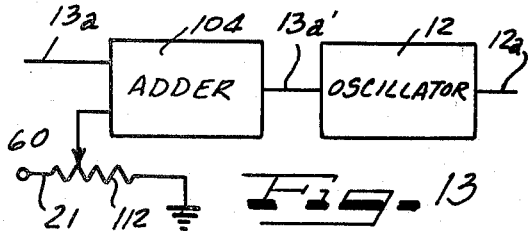
FIG. 13
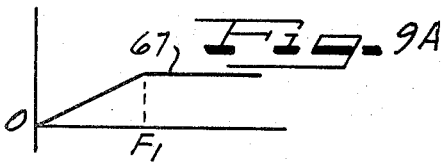
FIG. 9A
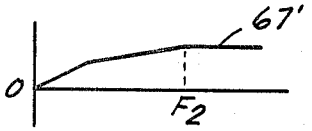
FIG. 9B

MONOPHONIC TOUCH SENSITIVE KEYBOARD

This is a continuation of application Ser. No. 591,853, filed June 30, 1975, and now abandoned.

BACKGROUND OF THE INVENTION

1. Field of the Invention

The present invention relates to electronic musical instruments, and more particularly to a monophonic instrument with a touch sensitive keyboard for selecting tones and for controlling the amplitude with which such tones are produced.

2. The Prior Art

It is frequently desirable, in keyboard type musical instruments, to produce tones and other sounds with a variable amplitude or volume, under the control of the operator or player of the instrument. By this means, the operator can produce loud or soft sounds at will. Several arrangements have been developed in the prior art for performing such a function.

In monophonic instruments, such as electronic music synthesizers or the like, where a single tone is produced at any one time, it is desirable to provide a keyboard by which the amplitude of the sound is produced in a continuous manner, so that such a sound, produced continuously without interruption, may be continuously varied up or down in its amplitude or volume, without any interruption in the production of the sound. The apparatus which is available in the prior art does not provide means by which this may readily be done.

It is therefore desirable to provide a touch sensitive keyboard by which the volume or amplitude of a sound may be continuously varied, in response to the force applied to the keys of the keyboard, with such sound being initiated with the first touch of the key corresponding to such sound.

It is also desirable to provide a touch sensitive keyboard, having means for producing a control voltage in response to the force applied to the keys of the keyboard, which voltage can be used to control other parameters, such as the cutoff frequency of a filter, vibrato amplitude and frequency, or pitch bending.

SUMMARY OF THE INVENTION

It is a principal object of the present invention to provide a touch sensitive keyboard by which the production of sounds may be initiated and parameters affecting production of such sounds may be varied at the will of the operator or player.

It is another object of the present invention to provide such a keyboard which is simple in construction and economical to produce.

It is a further object of the present invention to provide such a keyboard by which the amplitude of sounds, or other parameters, may be varied continuously.

Another object of the present invention is to provide a variable capacitance apparatus for such a keyboard, constructed so that the capacitance varies as a function of the force applied to a key.

A further object of the present invention is to provide such a variable capacitance apparatus, with means for compensating for changes in the quiescent capacitance of the apparatus.

These and other objects and advantages of the invention will become manifest by an inspection of the following description and the accompanying drawings.

In one embodiment of the invention there is provided, in an electronic musical instrument, a touch sensitive keyboard having a deformable conductive body separated by a dielectric from another conductive body. As a key is depressed, a downwardly directed force deforms the deformable conductive body in a manner such as to increase a capacitance between the two conductive bodies. The change in capacitance is sensed by a control circuit which produces a control voltage in response to the capacitance. The control voltage is used to modify the characteristics of sounds produced by the instrument. The control circuit includes an oscillator connected to a bridge circuit including the variable capacitor of the keyboard unit. A comparator senses the voltage corresponding to the quiescent capacitance of the variable capacitor, and produces a compensated voltage which is independent of ambient changes in the quiescent capacitance of the variable capacitor.

In another embodiment the variable capacitor unit of the keyboard has a circular cylindrical conductive body resting on a bed of conductive elastomer. As a key is depressed, force is applied to the body to drive it into greater surface contact with the bed, and increase the capacitance in accordance with the force acting on the key.

BRIEF DESCRIPTION OF THE DRAWINGS

Reference will now be made to the accompanying drawings, in which:

FIG. 8 is a series of graphs a-h representing waveforms present at different locations in the amplitude control circuit during operation thereof;

FIG. 9 is a series of graphs 9A and 9B representing two plots of the gain characteristic of the variable gain amplifier of FIG. 1; and FIGS. 10–13 are functional block diagrams of alternative embodiments of the present invention.

DESCRIPTION OF THE PREFERRED EMBODIMENTS

Figure 1:
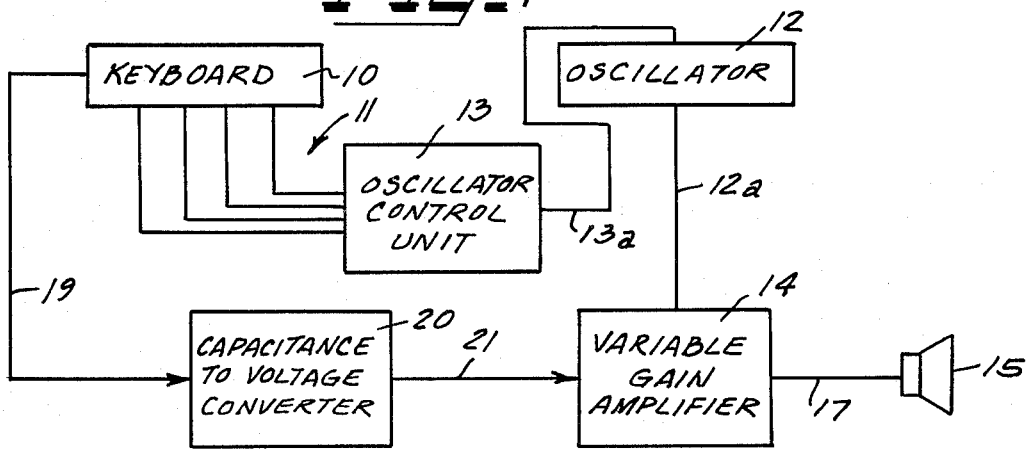
FIG. 1 is a functional block diagram of a monophonic musical instrument incorporating an illustrative embodiment of the present invention.

Referring to FIG. 1, which shows an illustrative embodiment of the present invention, a monophonic musical instrument incorporating a touch sensitive keyboard is shown. The keyboard 10 has a plurality of output lines 11 which are all connected to an oscillator control unit 13, each line corresponding to a separate key of the keyboard 10. The control unit 13 produces a voltage level on a line **13*a*, which line is connected to the control input of a variable frequency oscillator 13. The frequency of the oscillator is determined by the voltage level on the line 13*a*. The signal produced by the oscillator 12** is furnished, in the embodiment of FIG.

1, over a line 12*a* to a variable gain amplifier 14, the output of which is connected via a line 17 to a sound transducer, such as a loudspeaker 15. A variable capacitor located in the touch sensitive keyboard 10 is connected by a line 19 to the input of a capacitance-to-voltage converter 20, which produces a DC control voltage on an output line 21 in accordance with the capacitance changes. The control voltage is connected via line 21 to the control input of the variable gain amplifier 14.

The oscillator control unit 13, the variable frequency oscillator 12, and the variable gain amplifier 14 are well known in electronic music synthesizers, and therefore need not be described in detail. In general, the control unit incorporates apparatus for converting the signals developed on one of the lines 11 (in response to operation of individual keys of the keyboard 10) into a voltage proportional to the pitch associated with the depressed key. Typically, such apparatus takes the form of a voltage divider having a plurality of taps, with the voltage present on one tap being directly or indirectly connected to the output line 13*a*, which is connected via one of the lines 11 to the oscillator 12. Typically, means is provided either in the keyboard unit 10 or in the control unit 13 for producing a gating signal when any key is depressed, and this gating signal either energizes the oscillator 12 or enables a gate connected to its output, so that there is no signal on the line 12*a* except when a key of the keyboard has been depressed. The details of the oscillator control unit 13, the oscillator 12, and the variable gain amplifier 14 form no part of the present invention.

Figure 2:
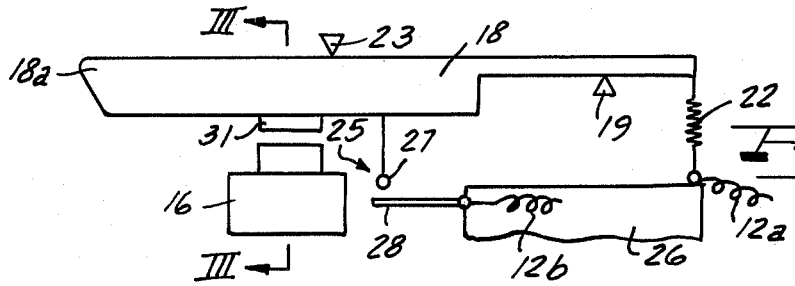
FIG. 2 is a side elevation of a touch sensitive key showing the variable capacitor in diagrammatic form.

In FIG. 2, which shows a side view of one key 18, a variable capacitor unit 16 is shown beneath an intermediate part of the key 18. A switch 25 is arranged adjacent the variable capacitor unit 16. Both the variable capacitor unit 16 and the switch 25 are actuated when the key 18 is depressed.

The key is supported by a fulcrum 19, and is urged to rotate in a clockwise direction by a spring 22, connected between the key and a support 26. A stop 23 maintains the key in the position shown when it is unoperated. When the key 18 is to be operated, its upper surface near the free end 18*a* is depressed, and the key rotates counterclockwise about the fulcrum 19.

The switch 25 has an upper contact 27 rigidly supported by and depending from the bottom surface of the key 18. A lower contact 28 is supported by the support 26. In the unoperated, or key-up, position of the key 18, a slight gap separates the contacts 27 and 28. The lower contact 28 is formed of resilient material so that, when the key 18 is depressed and the switch 25 is closed, the lower contact 28 is bent downwardly as the key 18 continues its downward motion. The upper end of the spring 22 is electrically connected to the upper contact 27. A pair of wires 12*a* and 12*b* are connected to the spring 22 and the contact 28, to connect the switch 25 to the selector 13.

The variable capacitor unit 16 is located directly below a pad 31 connected to and supported by the bottom surface of the key 18. In the key-up position, a slight gap exists between the unit 16 and the pad 31, which slightly exceeds the gap between the contacts of the switch 25, so that the switch 25 closes just prior to contact between the pad 31 and the variable capacitor unit 16.

Figure 3:
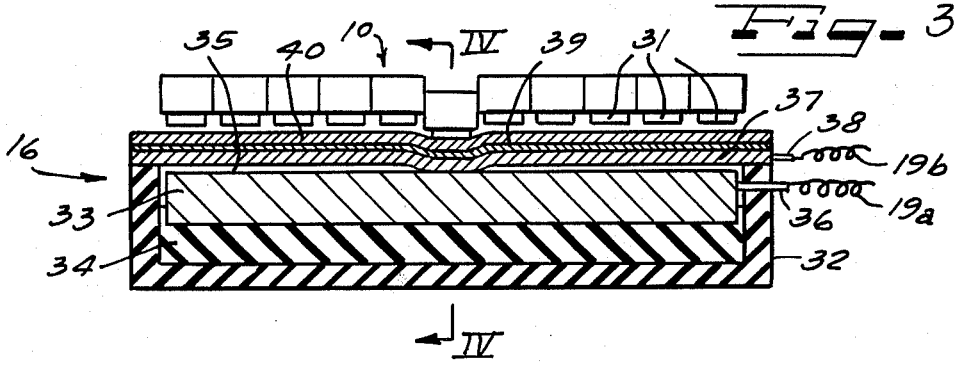
FIG. 3 is a vertical cross-sectional view of a touch sensitive keyboard taken in the plane 3—3 of FIG. 2.
Figure 4:
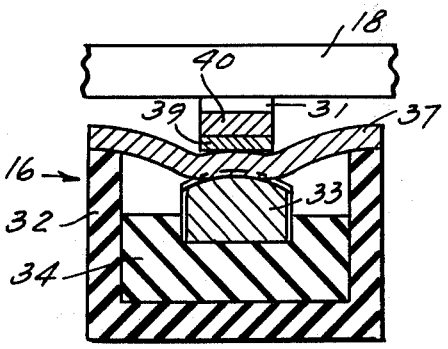
FIG. 4 is a vertical cross-sectional view of the apparatus of FIG. 3 taken in the plane 4—4.

FIGS. 3 and 4 illustrate the internal construction of the variable capacitor unit 16. A channel shaped member 32 extends the entire length of the keyboard 10. A layer 34 of insulating material overlies the bottom of the channel, and a conductive body 33 having a rounded or convex top surface 35 and elongated design is received in a recess in the top surface of the layer 33 and is supported thereby (FIG. 4). The conductive body 33 extends the entire length of the keyboard 10, as shown in FIG. 3. A terminal 36 is electrically connected with the member 33 and extends through an aperture in the supporting channel 32. A wire 19*a* is connected to the terminal 36.

A deformable conductive member 37, in the shape of a ribbon, overlies the layer 34 and the member 33 throughout the entire length of the channel 32. A terminal 38 is electrically connected to the conductive ribbon 37, and a wire 19*b* is connected thereto. The deformable conductive ribbon 37 is preferably formed of a conductive elastomer. It normally occupies a horizontal plane spaced above the conductive member 33. To this end, the side edges of the ribbon 37 are supported by the upper ends of the sides of the channel 32, to which its side edges are attached. The ribbon 37 is deformable downwardly toward the member 33 upon actuation of a key, by means which will now be described.

A flexible spring strip 39 is positioned directly above the conductive body 33, and is supported by the ribbon 37. An elongated cushion 40 having a length similar to the spring strip 39 is mounted directly above the strip 39. The pad 31, which is mounted to the bottom of each key 18, contacts the cushion 40 when the key 18 is depressed, and the deformable member 37 is forced downwardly to assume a new position in which the deformable member conforms to the outside shape of the conductive body 33. If the key is depressed with only slight force, only a minor portion of the member 37 conforms to the shape of the member 33. If the force is increased, a larger and larger area of the member 37 conforms to the shape of the member 33.

The member 33 is preferably formed of aluminum, and its outer surface is formed by a thin skin of insulating aluminum oxide. Thus, when the body 37 contacts the body 33, there is no direct electrical contact established between the wires 19*a* and 19*b*, but the capacitance effectively connected between these two wires varies with the size of the area of the body 37 which conforms to the shape of the body 33. The greater is this area, the greater the capacitance between the wires 19*a* and 19*b*. This is because the bodies 37 and 33 form a capacitor having the insulating skin of the body 33 as its dielectric and an effective plate area corresponding to the area of the body 37 which conforms to the body 33, as nearly all of the remainder of the body 37 is spaced much further away from the body 33 and thus contributes little to the total capacitance between the wires 19*a* and 19*b*.

The shape of the curved upper surface 35 of the body 33 determines the relationship between downward movement of the key 18 and the increase in capacitance of the variable capacitor. If the radius of curvature of this surface is large, a relatively great increase in capacitance accompanies depression of the key 18 for a short distance. Making the radius of curvature shorter gives less increase in capacitance per unit distance of key depression.

The convex surface 35 is not necessarily circular in cross section, but may instead be parabolic or hyperbolic or elipsoidal, all of which give different characteristics of the rate of change of capacitance in response to the position of an operated key.

The spring strip 39 is effective to maintain about the same characteristic of capacitance versus key depression irrespective of which of the keys of the keyboard is depressed.

Figure 5:
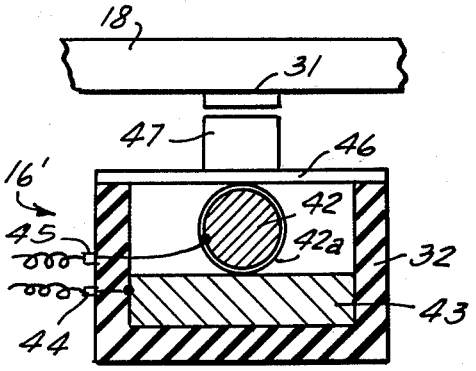
FIG. 5 is a vertical cross-sectional view corresponding to FIG. 4 but illustrating an alternate embodiment of the variable capacitor unit.

The variable capacitor unit 16' illustrated in FIG. 5 is an alternative embodiment. The deformable conductive member 37 of the embodiment of FIGS. 1–4 tends to stretch and deform permanently with repeated operations. As a result, the dynamic capacitance range decreases with use. In the unit 16', a conductive member 42, having an insulating skin 42*a*, is supported on a layer 43 of deformable conductive material supported in the channel 32. The layer 43 is connected to a terminal 44. The member 42, shaped as an elongate rod, rests upon the conductive layer 44, and is electrically connected to a terminal 45. A non-conductive elastomer sheet member 46 is secured to and closes the top of the channel 32, and provides a mounting surface for an elongate cushion 47, extending the entire length of the channel 32. The spring member 39 of the embodiment of FIGS. 3 and 4 is not needed, since the rod-shaped body 42 supports the non-conductive sheet 46 and the cushion 47.

Figure 6:
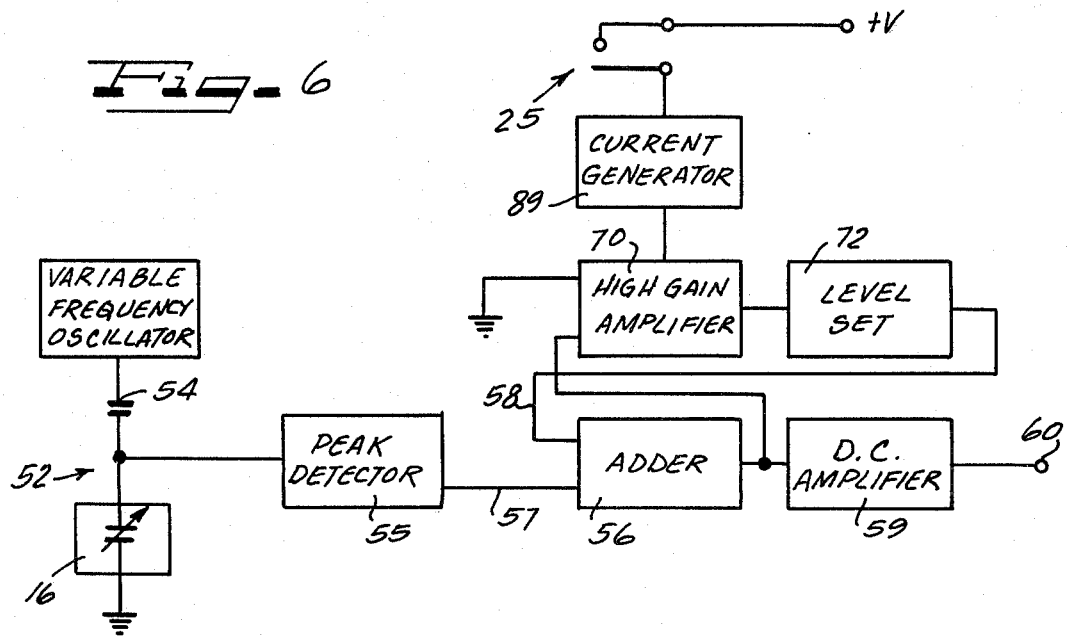
FIG. 6 is a functional block diagram of the amplitude control circuit of FIG. 1.

Referring to FIG. 6, a high frequency oscillator 53 with a preferred operating frequency near 100 kHz drives a capacitive voltage divider 52, including a fixed capacitor 54 and the variable capacitor unit 16, connected in series between the oscillator 53 and ground. The input voltage to the voltage divider 52 is illustrated in FIG. 8*a* as waveform 61, and the junction point between the capacitors is illustrated in FIG. 8*b* as waveform 62. The magnitudes of the two waveforms 61 and 62 differ in respect to the depression of a key, which causes the capacitance of the unit 16 to vary, giving the voltage available at the junction between the capacitors a low frequency modulation, in response to depression and release of a key.

A peak detector unit 55, connected to this junction, detects the input waveform 62 to provide an output voltage waveform 63 of magnitude −V1, as shown in FIG. 8*c*. The hump in the waveform 63 indicates the change in capacitance resulting from the depression and release of a key 18. The output voltage from the peak detector 55 is connected to one input of an adder unit 56 over a line 57. Another input of the adder unit 56 receives a correction signal over the line 58, having a waveform 66, as shown in FIG. 8*f*. The output of the adder is represented by voltage waveform 64, shown in FIG. 8*d*. This output is connected to an input of a DC amplifier 59. The waveform 64 is similar in shape to the waveform 63, but has its DC level shifted so that during the key-up state, before the pad 31 engages the ribbon 37, the output voltage from the adder 56 is at or near zero. Hence, the output of the DC amplifier 59 is also at or near zero. The output of the DC amplifier 59 is connected to an output terminal 60. The waveform 68, illustrated in FIG. 8*g*, illustrates the output voltage waveform of the DC amplifier 59.

The correction voltage waveform 66 is developed by a high gain amplifier 70 and a level set unit 72. During the key-up condition the switch 25 is open. During this time, the amplifier 70 is controlled by a gating current produced by a current generator 89 (waveform 65 in FIG. 8*e*). The output of the amplifier 70 corresponds to the difference between ground potential and the output of the adder 56, to which the two input (inverting and noninverting) terminals of the amplifier are connected. The output of the amplifier 70 is a DC voltage level corresponding to the output of the adder 56, but having the opposite sign. This is connected to the input of the level set unit 72, which functions as a sample-and-hold unit to charge a capacitor in accordance with the input signal, and to manifest the voltage level across the capacitor at an output terminal connected to the adder 56 by the line 58. The effect is to produce a voltage on the line 58 which is equal and opposite to the quiescent voltage on the line 57, so as to compensate for the quiescent capacitance of the variable capacitor 16 and any changes therein.

As the key 18 is depressed, the contacts of the switch 25 apply a voltage +V to the current generator 89, which then discontinues supplying gating current to the amplifier 70, causing it to disconnect itself from the level set unit 72. The gating current furnished by the current generator 89 is shown in FIG. 8*e*. The level set unit 72 continues to manifest the same voltage level which is then present at its output, until the switch 25 is again opened. Subsequently, the voltage level of the output of the level set unit 72 is constant, and the voltage produced at the output terminal 60 follows the voltage changes on the line 57, as a result of changes in the capacitance of the variable capacitor 16.

Figure 7:
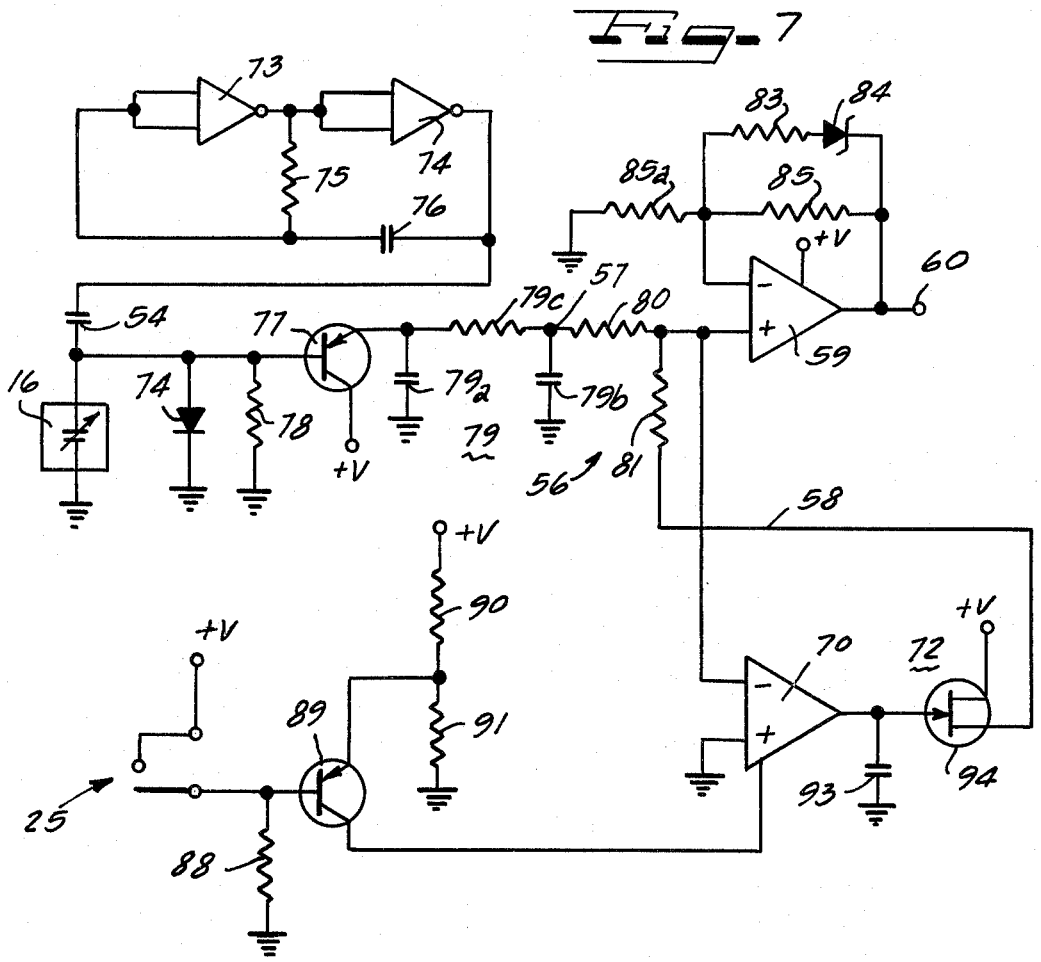
FIG. 7 is a schematic circuit diagram of the amplitude control circuit of FIG. 6.

A schematic circuit diagram of the apparatus of FIG. 6 is shown in FIG. 7. The high frequency oscillator 53 is composed of inverters 73 and 74, connected in series, with an RC time constant circuit including a resistor 75 and a capacitor 76. The resistor 75 is connected between the input and the output of the gate 75, and the capacitor 76 is connected between the output of the gate 74 and the input of the gate 73.

The output voltage from inverter 74 is connected through the capacitor 54 to the variable capacitor unit 16. The base of a PNP transistor 77 is connected to the junction of capacitor 54 and the variable capacitor unit 16. A resistor 78 is connected between the base of transistor 76 and ground, and a diode 79 is also connected between the base of transistor 77 and ground, to clamp the positive-going portion of the waveform 62 to ground. The collector of the transistor 77 is connected to the supply voltage +V, and the emitter drives a low pass filter network 79 comprising shunt capacitors 79*a* and 79*b* and series resistor 79*c*. The transistor 77 functions as a rectifier and the low pass filter 79 smooths the rectified voltage. Together they make up the peak detector 55.

Resistors 80 and 81 make up the adder unit 56. Resistor 80 connects the line 57, from the output of the low pass filter network 79, to the noninverting input of the DC amplifier 59. Resistor 81 couples the line 58 to the same input of the amplifier 59.

The DC amplifier 59 has a resistor 85 connected between its output terminal and the inverting input, and a resistor 85*a* connected between the inverting input and ground, to establish the gain of the amplifier. A series circuit including a zener diode 84 and a resistor 83 is connected in parallel with the resistor 85, to give a nonlinear gain characteristic. Without the diode 84 and the resistor 83, the gain of the amplifier 59 would be constant for all input voltage levels. It is desirable, however, to provide a nonlinear characteristic to prevent the amplifier 59 from saturating, for if the amplifier were permitted to saturate, increased downward force on the key 18 would produce no change in output voltage of the amplifier 59, producing a flat topped output signal (69 in FIG. 8*g*). Saturation could be prevented by simply limiting the gain of the amplifier, but it is desirable to have a steeper characteristic for low key forces, so that there is a dramatic change in amplitude to differentiate a moderate from a light touch on the keys of the keyboard. The curve 67 of FIG. 9A, which is a graph of the output of amplifier 59 as a function of the force of key depression, shows that when the gain is constant, saturation occurs at force $F_1$. Curve 67' of FIG. 9B shows that with the nonlinear gain characteristic, the same slope is provided for low forces, but saturation is avoided until the higher force $F_2$.

The switch 25 is connected between the supply voltage +V and the base of the current generator 89, which comprises a PNP transistor. The base is also connected to ground through a resistor 88. The emitter of the transistor 89 is connected to the junction of a pair of resistors 90 and 91, which resistors serve as a voltage divider between the supply voltage +V and ground. The collector is connected to the gating terminal of the amplifier 70.

The inverting input of the gated high gain amplifier 70 is connected to the output of the adder unit 56, and its noninverting input is grounded; its output is connected to one terminal of a capacitor 93, the other terminal of which is grounded. The amplifier 92 functions as a means to charge and discharge the capacitor 93, in accordance with the difference in voltage applied to its inputs, as long as it receives gating current from the transistor 89.

The output of the amplifier 70 is also connected to the gate of an FET 94, which has its drain and source terminals connected in series between a voltage source +V and the line 58. The FET 94 functions as a source follower, and its high input impedance permits the voltage level capacitor 93 to remain constant for long periods of time. The capacitor 93 and its associated circuitry thus function as a sample-and-hold circuit.

In operation, the capacitor 93 is charged by the amplifier 70 to the value necessary to bring the output of the adder unit 56 to zero, which permits the amplifier 70 to cease charging or discharging the capacitor 93, which thereafter has a constant voltage impressed across it. If the quiescent capacitance of the variable capacitor 16 changes, the change in the voltage level on the line 57 causes the amplifier 92 to charge or discharge the capacitor 93 in such a way as to compensate for the change, and bring the output of the adder unit 56 back to zero.

When a key 18 of the keyboard is depressed, the switch 25 is closed, and a high voltage is connected to the base of the transistor 89. This cuts off the transistor and turns off the gating current for the amplifier 70, so that it becomes ineffective to charge or discharge the capacitor 93, irrespective of its input. The subsequent change in the capacitance of the variable capacitor 16, therefore, as a key 18 is depressed further, changes the level on the line 57 with no corresponding change in the voltage level present on the line 58, since the voltage across the capacitor 93 remains constant.

As the key 18 is released by the operator or player, the capacitance of the variable capacitor 16 returns to its quiescent value before the switch 25 is reopened. Thereafter, any intervening or subsequent change in quiescent capacitance is compensated for in the manner described.

Although the present invention has been described particularly in relation to the control of the volume of sound produced via a variable gain amplifier 14, it finds utility in other control operations as well. Four additional arrangements are shown in FIGS. 10–13, illustrating four additional modes of use of the present invention.

In FIG. 10, a filter 99 having a variable cutoff frequency is shown, and the signal produced by the oscillator is conducted over the line **12*a* to the signal input of the filter, the filtered output being connected over a line 100 to the input of an amplifier 102, the output of which is connected to the loudspeaker 15 over the line 17. The terminal 60 of the capacitance-to-voltage converter 20 is connected via the line 21 to the control input of the filter 99. Variation in the voltage level on the line 21 affects the cutoff frequency of the filter 99, which causes a dramatic change in the sound produced by the loudspeaker 15. In FIGS. 11–13, the control signal furnished over the line 13*a* is modified by operation of an adder unit 104, producing a modified signal which is connected over the line 13*a'* to the control input of the oscillator 12. The adder 104 receives, in each case, one input from the line 13*a*, but the second input is different. In FIG. 11, the output of another oscillator 106 is connected to the second input of the adder 104, the frequency of which is controlled by the voltage level present at the terminal 20. The signal from the oscillator 106, when added to the signal on the line 13*a*, causes a vibrato effect, the frequency of which is controlled by the potential on the line 21**.

In FIG. 12, the second input of the adder 104 is supplied from the output of a variable gain amplifier 108, which has its signal input connected to the output of a fixed frequency oscillator 110. The gain of the amplifier 108 is controlled by the voltage level on the line 21, so that a variable amount of the signal from the oscillator 110 is mixed with the signal on the line **13*a*. As the oscillator 110 operates at a relatively low frequency, the effect on the sound produced is a vibrato, with a vibrato frequency equal to the frequency of the oscillator 110, and with the amount or amplitude of vibrato determined by the voltage level on the line 21**.

In FIG. 13, the second input of the adder unit 104 is connected directly to the line 21, through a variable voltage divider 112, so that variation of the voltage level on the line 21 affects the pitch of the oscillator 21. The amount of the pitch change, in relation to the change in the voltage, is controlled by adjustment of the variable resistor 112. The operator or player of the instrument can slightly change or "bend" the pitch of the oscillator 12 in accordance with the force used on the keys.

It will be understood by those skilled in the art that while the arrangements shown in FIGS. 1 and 10–13 all use the control voltage on the line 21 for an individual purpose, the control voltage may be simultaneously used to perform two or more of the several functions described. By the use of suitable switches, the control voltage may be selectively supplied to one or several destinations, so that the operator or player can select the desired effect at any given time.

The several arrangements shown in FIGS. 1 and 10–13 are merely illustrative of ways in which the control voltage may be used, and other uses will be apparent to those skilled in the art.

From the foregoing, it is apparent that the present invention is effective to permit the continuous control of characteristics of a sound or tone selected by a key of the keyboard, as long as the key remains depressed, in accordance with the force with which it is depressed, and compensates completely for any changes in quiescent capacitance.

Although the invention has been described in connecton with a monophonic musical instrument, it is obvious that an individual variable capacitor may be provided for each key, to permit the simultaneous control of the amplitudes of more than one sound. Other modifications and additions may be made without departing from the essential features of the invention, which are intended to be defined and secured by the appended claims.

What is claimed is:

1. In an electronic musical instrument having a keyboard with a plurality of keys, a tone signal generator for producing a tone signal, means for controlling said tone signal generator is response to operation of said keys and an output system for receiving said tone signal and converting the same into sound waves, the combination comprising:

(a) sensing means underlying all of the keys of said keyboard and responsive to a plurality of said keys for sensing the force with which said keys are operated and for producing a signal having a level corresponding to the sum of said forces, and (b) amplifier means connected to said sensing means and to said output system for controlling the amplitude of said sound waves in response to said signal, in accordance with the sum of the forces of the operated keys.

2. Apparatus according to claim 1, wherein said sensing means comprises a variable capacitor unit having first and second conductors and a dielectric therebetween, said first conductor being mechanically connected to said key for changing its position relative to said second conductor to cause the capacitance of said capacitor to vary in response to a force applied to said key, and voltage producing means connected to said variable capacitor for producing a DC voltage in response to the capacitance of said variable capacitor.

3. A variable capacitance unit for the keyboard of an electronic musical instrument for producing a signal responsive to the sum of the forces with which the keys of said keyboard is operated, comprising:

(a) a first conductor disposed below said keyboard and extending along the entire length thereof, (b) a second conductor supported above said first conductor and adapted to be moved downwardly in response to operation of one of said keys, (c) a dielectric layer interposed between said first and second conductors for maintaining them electrically insulated from each other, and (d) electrical conductor means secured to said first and second conductors for manifesting an electrical signal in response to the capacitance between said first and second conductors, whereby said electrical signal responds to the sum of the forces of the operated keys.

4. Apparatus according to claim 3, wherein said first conductor comprises an elongate conductive body and said second conductive body comprises a conductive elastomer supported in a plane above said first conductor and adapted to be deformed downwardly in response to key operation.

5. Apparatus according to claim 4, wherein the upper surface of said first conductor is a convex curved cylindrical surface.

6. Apparatus according to claim 5, including resilient means interposed between said key and said second conductor whereby said second conductor is forced downwardly over an area exceeding the area of contact between said key and said resilient means, a portion of said second conductor being adapted to be pushed downwardly sufficiently as to conform to the upper surface of said first conductor, the area of said conforming portion depending on the force with which said key is operated.

7. Apparatus according to claim 4, including spring means supported above said second conductor and adapted to be stretched downwardly in response to operation of said key, thereby to force said second conductor downwardly toward said first conductor.

8. Apparatus according to claim 3, wherein said first conductor comprises a conductive elastomer and said second conductor comprises an elongate cylindrical body supported on said elastomer, and including means interposed between said key and said second conductor for engaging said second conductor and forcing it downwardly so as to displace a portion of said first conductor.

9. Apparatus according to claim 8, including resilient means interposed between said key and said second conductor.

10. Apparatus according to claim 8, wherein said second conductor comprises a round conductive bar with a thin coating of insulating material.

11. In an electronic musical instrument having a keyboard with a plurality of keys, a tone signal generator for producing a tone signal, means for controlling said tone signal generator in response to operation of said keys and an output system for receiving said tone signal and converting the same into sound waves, the combination comprising:

(a) sensing means juxtaposed with said keyboard and responsive to a plurality of said keys for sensing the force with which said keys are operated and for producing a signal having a level corresponding to said force, (b) amplifier means connected to said sensing means and to said output system for controlling the amplitude of said sound waves in response to said signal, and (c) means connected with said sensing means for compensating said sensing means against changes in ambient conditions.

12. In an electronic musical instrument having a keyboard with a plurality of keys, a tone signal generator for producing a tone signal, means for controlling said tone signal generator in response to operation of said keys and an output system for receiving said tone signal and converting the same into sound waves, the combination comprising:

(a) sensing means juxtaposed with said keyboard and responsive to a plurality of said keys for sensing the force with which said keys are operated and for producing a signal having a level corresponding to said force, (b) amplifier means connected to said sensing means and to said output system for controlling the amplitude of said sound waves in response to said signal, (c) said sensing means comprising a variable capacitor unit having first and second conductors and a dielectric therebetween, said first conductor being mechanically connected to said key for changing its position relative to said second conductor to cause the capacitance of said capacitor to vary in response to a force applied to said key, and voltage producing means connected to said variable capacitor for producing a DC voltage in response to the capacitance of said variable capacitor, and (d) said voltage producing means including an adder unit and means for generating a correction voltage which is equal and opposite to said DC voltage for the quiescent capacitance of said variable capacitor.

13. A variable capacitance unit for the keyboard of an electronic musical instrument for producing a signal responsive to the force with which a key of said keyboard is operated, comprising:

(a) a first conductor disposed below said keyboard and extending along the length thereof, (b) a second conductor supported above said first conductor and adapted to be moved downwardly in response to operation of one of said keys, (c) a dielectric layer interposed between said first and second conductors for maintaining them electrically insulated from each other, (d) electrical conductor means secured to said first and second conductors for manifesting an electrical DC signal in response to the capacitance between said first and second conductors, and (e) detection means for sensing the quiescent capacitance of said variable capacitor and for producing a signal responsive thereto, and means connected to said variable capacitor and to said detection means for producing an output signal which is compensated for quiescent capacitance.

* * * * *